US008534745B1

(12) United States Patent
Quinn et al.

(10) Patent No.: US 8,534,745 B1
(45) Date of Patent: Sep. 17, 2013

(54) MULTI STAGE CLOSURE ASSEMBLY

(75) Inventors: Shawn G. Quinn, Grand Blanc, MI (US); Michael E. McGuire, Milford, MI (US); Scott W. Thorpe, Milford, MI (US); Altaf S. Imam, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/424,615

(22) Filed: Mar. 20, 2012

(51) Int. Cl.
*E05B 15/02* (2006.01)

(52) U.S. Cl.
USPC ..... 296/146.9; 292/340; 292/341.12; 292/DIG. 3

(58) Field of Classification Search
USPC ..... 296/146.1, 146.5, 146.6, 146.8, 146.9, 296/155; 49/503; 292/1, 13, 80, 84, 137, 292/145, 216, 340, 341.11, 341.12, 341.13, 292/341.15, 341.17, 341.18, 342, DIG. 3, 292/DIG. 55, DIG. 56, DIG. 61, DIG. 73
See application file for complete search history.

(56) References Cited

U.S. PATENT DOCUMENTS

| | | | | |
|---|---|---|---|---|
| 7,029,043 | B2 * | 4/2006 | Fisher | 292/341.13 |
| 2007/0114802 | A1 * | 5/2007 | Johnson et al. | 292/340 |
| 2013/0031843 | A1 * | 2/2013 | Thorpe et al. | 49/503 |
| 2013/0031844 | A1 * | 2/2013 | Quinn et al. | 49/503 |

* cited by examiner

*Primary Examiner* — Glenn Dayoan
*Assistant Examiner* — Jason S Daniels
(74) *Attorney, Agent, or Firm* — Quinn Law Group, PLLC

(57) ABSTRACT

A closure assembly for securing a moveable panel relative to a body of a vehicle includes a striker assembly and a latch mechanism. A biasing mechanism includes a bumper fixedly attached to the striker assembly, and an arm fixedly attached to the latch mechanism. The arm is flexible about an axis in one of an inward direction or an outward direction. The arm engages the bumper and is biased inward in response to movement of the latch mechanism toward the striker assembly for simultaneously biasing the latch mechanism in a lateral direction and an axial direction to dampen movement of the latch mechanism relative to the striker assembly.

19 Claims, 2 Drawing Sheets

MULTI STAGE CLOSURE ASSEMBLY

TECHNICAL FIELD

The invention generally relates to a closure assembly for securing a moveable panel, such as a liftgate, a decklid, or a hatch, to a body of a vehicle.

BACKGROUND

Vehicles include moveable panels for sealing openings in a body of the vehicle. The moveable panels may be but are not limited to a liftgate for sealing a rear opening of a Sport Utility Vehicle (SUV), a decklid for sealing a trunk space of a sedan, or a hatch for sealing a rear opening of a hatchback. It should be appreciated that the opening and the moveable panel may be located anywhere on the vehicle, and may be positioned in any suitable orientation.

A closure assembly secures the moveable panel relative to the body of the vehicle. The closure assembly includes a striker assembly and a latch mechanism. Typically, the striker assembly is attached to the body, and the latch mechanism is attached to and moveable with the panel. However, the relative positions of the striker assembly and the latch mechanism may be reversed, with the latch mechanism attached to the body and the striker assembly attached to and moveable with the panel. The striker assembly includes a wire striker, which generally forms a loop. The panel and the latch mechanism move along a path into and out of engagement with the striker assembly. The latch mechanism engages the wire striker of the striker assembly in interlocking engagement to secure the panel relative to the body. The interlocking engagement between the striker assembly and the latch mechanism must minimize and/or eliminate movement of the panel in both a lateral direction and/or a fore-aft direction to prevent undesirable noise, paint chips, and the structural feel of the panel.

SUMMARY

A closure assembly for securing a moveable panel relative to a body of a vehicle is provided. The closure assembly includes a striker assembly having a base and a wire striker fixedly attached to the base. A latch mechanism is moveable along a path between a closed position and an open position. When in the closed position, the latch mechanism is configured for engaging the wire striker in interlocking engagement to secure the latch mechanism relative to the striker assembly. When in the open position, the latch mechanism is configured for not engaging the wire striker in interlocking engagement to allow movement of the latch mechanism along the path relative to the striker assembly. A biasing mechanism includes a bumper fixedly attached to the base of the striker assembly, and an arm fixedly attached to the latch mechanism. The arm is flexible about an axis in one of an inward direction toward, or an outward direction away from the path. The arm engages the bumper and is moved inward toward the path in response to movement of the latch mechanism from the open position into the closed position. The inward movement of the arm biases the latch mechanism in both a lateral direction relative to the path and an axial direction along the path, which dampens movement of the latch mechanism relative to the striker assembly.

A vehicle is also provided. The vehicle includes a body defining an opening, and a panel moveably attached to the body for selectively sealing the opening. A closure assembly secures the panel relative to the body. The closure assembly includes a striker assembly having a base and a wire striker fixedly attached to the base, and a latch mechanism moveable along a path between a closed position and an open position. When in the closed position, the latch mechanism is configured for engaging the wire striker in interlocking engagement to secure the latch mechanism relative to the striker assembly. When in the open position, the latch mechanism is configured for not engaging the wire striker in interlocking engagement to allow movement of the latch mechanism along the path relative to the striker assembly. A biasing system includes a first biasing mechanism and a second biasing mechanism. The first biasing mechanism and the second biasing mechanism are mirror images of each other, with the first biasing mechanism disposed opposite the second biasing mechanism on opposing lateral sides of the path. Each of the first biasing mechanism and the second biasing mechanism includes a bumper fixedly attached to the base of the striker assembly, and an arm fixedly attached to the latch mechanism. The arm of each of the first biasing mechanism and the second biasing mechanism is flexible about an axis in one of an inward direction toward, or an outward direction away from the path. The arm of each of the first biasing mechanism and the second biasing mechanism engages the bumper of the first biasing mechanism and the second biasing mechanism respectively, and is biased inward toward the path in response to movement of the latch mechanism from the open position into the closed position. The arm of each of the first biasing mechanism and the second biasing mechanism is biased inward for simultaneously biasing the latch mechanism in a lateral direction relative to the path and an axial direction along the path to dampen movement of the latch mechanism relative to the striker assembly.

Accordingly, the arms of the first biasing mechanism and the second biasing mechanism bias against the bumpers of the first biasing mechanism and the second biasing mechanism respectively to bias the latch mechanism in opposing lateral directions to offset each other and minimize and/or eliminate any lateral movement of the latch mechanism relative to the striker assembly, thereby damping lateral movement of the closure assembly to manage chucking. Furthermore, the arms of the first biasing mechanism and the second biasing mechanism bias against the bumpers of the first biasing mechanism and the second biasing mechanism respectively to bias the latch mechanism against the wire striker in an axial direction, along the path of the latch mechanism, to maintain a constant pressure between the latch mechanism and the wire striker, thereby minimizing and/or eliminating any axial movement of the latch mechanism along the path of the latch mechanism, and damping axial movement of the closure assembly to manage chucking.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward,"

"top," "bottom," etc., are used descriptively for the figures, and do not represent limitations on the scope of the invention, as defined by the appended claims.

Referring to the Figures, wherein like numerals indicate like parts throughout the several views, a vehicle is generally shown at 20. The vehicle 20 includes a body 22 that defines an opening 24. The opening 24 may include, for example, a rear access to a cargo van or a sport utility vehicle, or a trunk to a sedan. It should be appreciated that the opening 24 may be located and oriented in any position on the body 22 of the vehicle 20. A panel 26 is moveably attached to the body 22, for example, by one or more hinges. The panel 26 moves between an open position, shown in FIGS. 1 and 2, to allow access to the opening 24, and a closed position, shown in FIG. 3, to selectively seal the opening 24.

Figure 1:
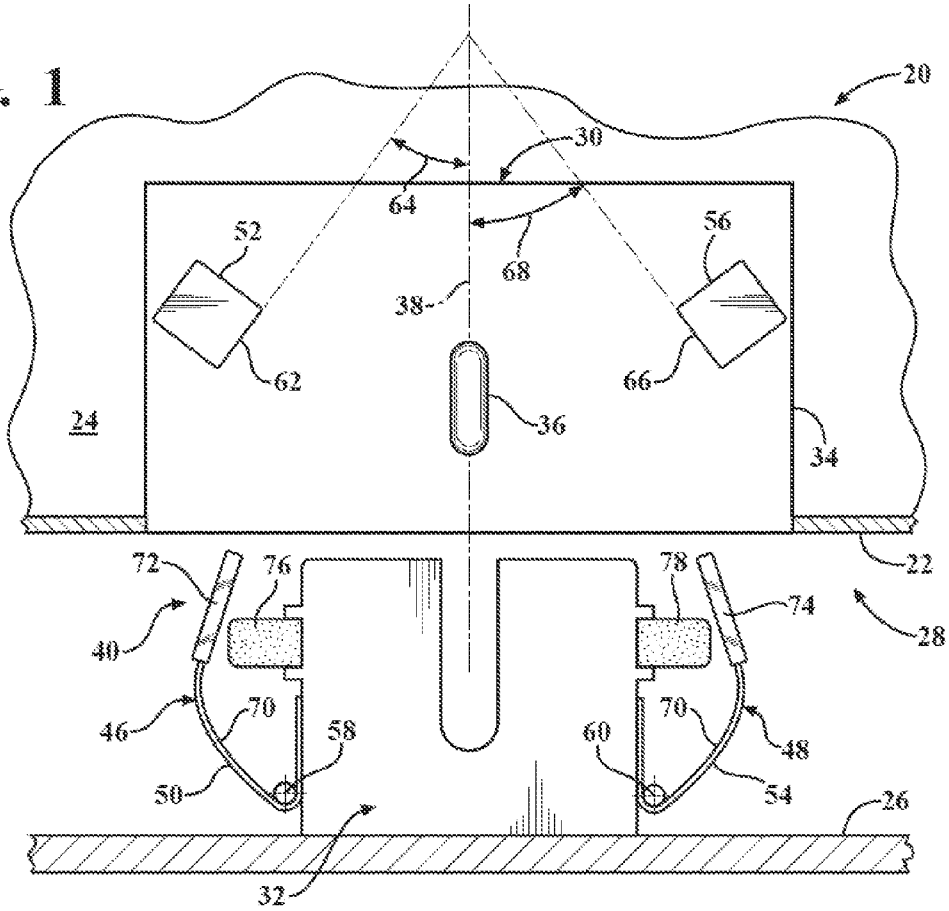
FIG. 1 is a schematic plan view of a vehicle showing a closure assembly in an open position.
Figure 2:
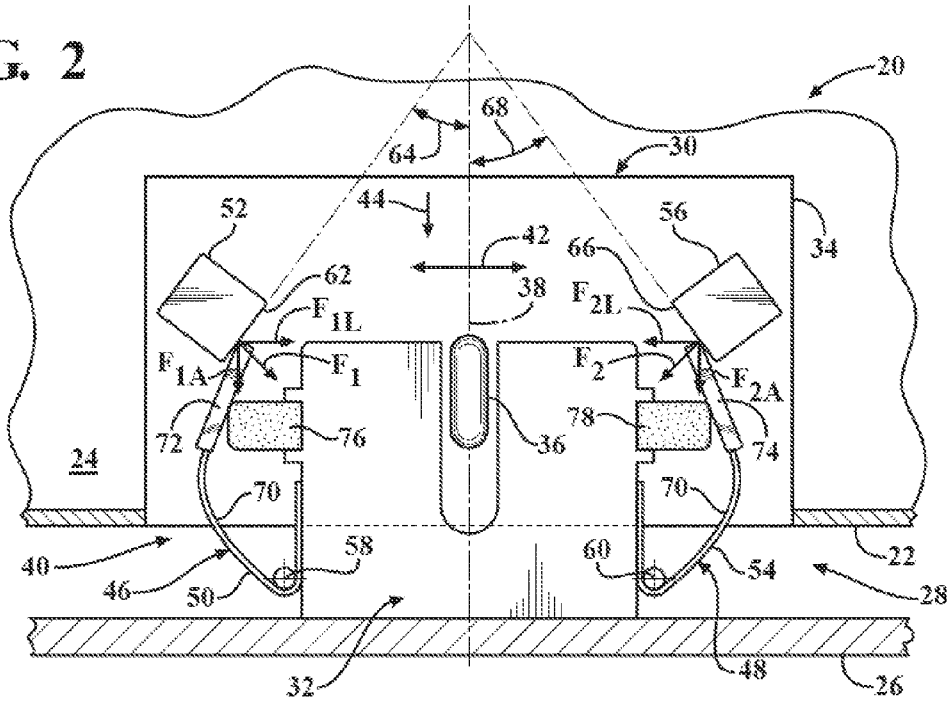
FIG. 2 is a schematic plan view of the vehicle showing the closure assembly in the open position with a biasing mechanism providing a first rate of damping resistance.
Figure 3:
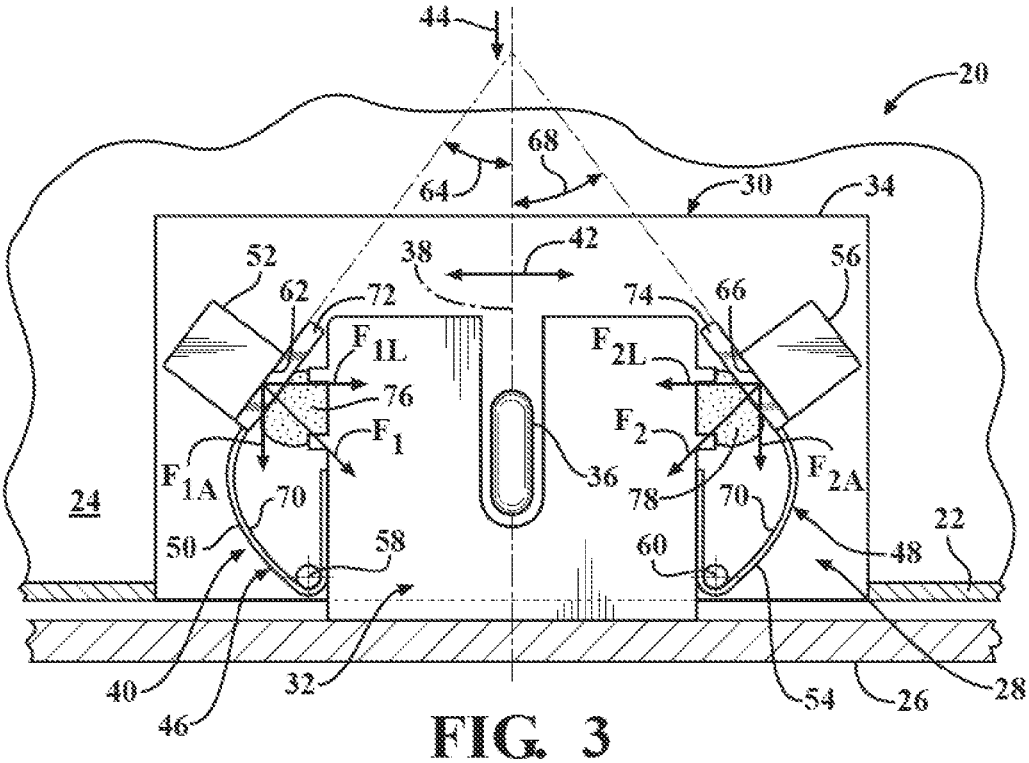
FIG. 3 is a schematic plan view of the vehicle showing the closure assembly in a closed position with the biasing mechanism providing a second rate of damping resistance.

A closure assembly 28 secures the panel 26 relative to the body 22 in the closed position. The closure assembly 28 includes a striker assembly 30 and a latch mechanism 32. The striker assembly 30 includes a base 34 supporting a wire striker 36. As shown, the base 34 is configured for attachment to the body 22 of the vehicle 20, and secures the wire striker 36 to the vehicle 20, with the panel 26 and the latch mechanism 32 moveable along a path 38 relative thereto. The wire striker 36 may define a loop as is known. As shown, the striker assembly 30 is attached to the body 22, and the latch mechanism 32 is attached to and moves with the panel 26 along the path 38, between the closed position and the open position. However, it should be appreciated that the relative positions of the striker assembly 30 and the latch mechanism 32 may be reversed, with the latch mechanism 32 attached to the body 22, and the striker assembly 30 attached to and moveable with the panel 26. The path 38 is generally aligned along a longitudinal axis of the wire striker 36. As shown in FIG. 3, the latch mechanism 32 engages the wire striker 36 in interlocking engagement to secure the latch mechanism 32 relative to the striker assembly 30. When the latch mechanism 32 and the panel 26 are in the open position, such as shown in FIGS. 1 and 2, the latch mechanism 32 does not engage the wire striker 36 in interlocking engagement, i.e., the latch mechanism 32 is disengaged from the interlocking engagement with the wire striker 36, to allow movement of the latch mechanism 32 and the panel 26 relative to the striker assembly 30. The latch mechanism 32 and wire striker 36 may include any suitable combination, and/or configuration known to those skilled in the art and/or capable of securely latching the panel 26 to the body 22. Accordingly, the specifics of the wire striker 36, the latch mechanism 32, and the operation of the interlocking engagement therebetween are not described in detail herein.

The closure assembly 28 includes a biasing system 40. When the latch mechanism 32 is disposed in the closed position in interlocking engagement with the wire striker 36, the biasing system 40 simultaneously biases the latch mechanism 32 in a lateral direction relative to the path 38 of the latch mechanism 32, i.e., substantially perpendicular to the path 38, and an axial direction along the path 38 of the latch mechanism 32, i.e., longitudinally along or parallel with the path 38. The lateral direction is generally indicated by the direction arrow 42 shown in FIGS. 2 and 3, and the axial direction is generally indicated by the direction arrow 44 shown in FIGS. 2 and 3. The biasing system 40 biases the latch mechanism 32 in the lateral direction 42 and the axial direction 44 to dampen movement of the latch mechanism 32 relative to the striker assembly 30. Accordingly, it should be appreciated that the biasing system 40 dampens movement within the closure assembly 32, i.e., the biasing system 40 dampens movement between the striker assembly 30 and the latch mechanism 32, thereby managing chucking of the panel relative to the body. As used herein, the term dampen may be defined as the dynamic displacement, bending or compression of an object to reduce the magnitude of a force and/or movement of another object.

The biasing system 40 includes a first biasing mechanism 46 and a second biasing mechanism 48. The first biasing mechanism 46 and the second biasing mechanism 48 are mirror images of each other, with the first biasing mechanism 46 disposed opposite the second biasing mechanism 48 on opposing lateral sides of the path 38, with the wire striker 36 disposed between the first biasing mechanism 46 and the second biasing mechanism 48.

The first biasing mechanism 46 includes a first arm 50 and a first bumper 52. The second biasing mechanism 48 includes a second arm 54 and a second bumper 56. The second arm 54 opposes the first arm 50, and is disposed opposite the first arm 50 across the path 38. The second bumper 56 opposes the first bumper 52, and is disposed opposite the first bumper 52 across the path 38. The first bumper 52 and the second bumper 56 are fixedly attached to the base 34 of the striker assembly 30. The first arm 50 and the second arm 54 are fixedly attached to the latch mechanism 32. The first arm 50 is flexible about a first axis 58 inward toward or outward away from the path 38, while the second arm 54 is flexible about a second axis 60 inward toward or outward away from the path 38. The first arm 50 and the second arm 54 are independently flexible relative to each other.

The first bumper 52 presents a first contact surface 62 for engaging the first arm 50. The first contact surface 62 is angled relative to the path 38 to define a first contact angle 64 therebetween. The first contact angle 64 is preferably but not necessarily between the range of 15° and 75°. Similarly, the second bumper 56 presents a second contact surface 66 for engaging the second arm 54. The second contact surface 66 is angled relative to the path 38 to define a second contact angle 68 therebetween. The second contact angle 68 is preferably but not necessarily between the range of 15° and 75°. Preferably, the first contact angle 64 and the second contact angle 68 are equal to each other. The angle of first contact surface 62 and second contact surface 66 relative to the path 38 directs a resultant force, generated from the first arm 50 engaging the first bumper 52 and the second arm 54 engaging the second bumper 56 respectively, inward toward the path 38 at a non-perpendicular angle relative to the path 38 (described in greater detail below).

The first arm 50 and the second arm 54 are flexible in response to relative movement between the latch mechanism 32 and the striker assembly 30 along the path 38. Accordingly, as the latch mechanism 32 moves along the path 38, the first arm 50 engages the first bumper 52 and/or the second arm 54 engages the second bumper 56, causing the first arm 50 and/or the second arm 54 to flex inward toward the path 38. The flexure of the first arm 50 and/or the second arm 54 generates a bias force within each of the first arm 50 and the second arm 54 independently of each other. The bias force of the first arm 50 and the second arm 54 simultaneously biases the latch mechanism 32 in the lateral direction 42 and the axial direction 44 to dampen movement of the latch mechanism 32 relative to the striker assembly 30.

Referring to FIGS. 2 and 3, the bias force $F_1$ of the first arm 50 is directed toward the latch mechanism 32 at an angle relative to the path 38 of the latch mechanism 32 due to the angle of the first contact surface 62 relative to the path 38. As such, the bias force $F_1$ of the first arm 50 includes a lateral component $F_{1L}$ and an axial component $F_{1A}$. The lateral component $F_{1L}$ of force $F_1$ biases the latch mechanism 32 in the lateral direction 42, and the axial component $F_{1A}$ of force $F_1$ biases the latch mechanism 32 in the axial direction 44. Similarly, the bias force $F_2$ of the second arm 54 is also directed toward the latch mechanism 32 at an angle relative to the path 38 of the latch mechanism 32 due to the angle of the second contact surface 66 relative to the path 38. As such, the bias force $F_2$ of the second arm 54 includes a lateral component $F_{2L}$ and an axial component $F_{2A}$. The lateral component $F_{2L}$ of force $F_2$ biases the latch mechanism 32 in the lateral direction 42, opposite and against lateral force $F_{1L}$, and the axial component $F_{2A}$ of force $F_2$ biases the latch mechanism 32 in the axial direction 44, in combination or addition to axial force $F_{1A}$. Accordingly, it should be appreciated that when the first arm 50 first contacts the first bumper 52 and/or the second arm 54 first contacts the second bumper 56, the axial components of the bias forces $F_1$ and $F_2$ are greater than the lateral components of the bias forces $F_1$ and $F_2$. However, as the latch mechanism 32 moves further inward along the path 38 toward the wire striker 36, thereby further flexing the first arm 50 about the first axis 58 and the second arm 54 about the second axis 60, the axial components of the bias forces $F_1$ and $F_2$ decrease, and the lateral components of the bias forces $F_1$ and $F_2$ increase. Furthermore, it should be appreciated that if the first arm 50 and the second arm 54 are centered between the first bumper 52 and the second bumper 56, the bias forces $F_1$ and $F_2$ are substantially equal in magnitude. However, if the latch mechanism 32 should move closer to one of the first bumper 52 or the second bumper 56, the magnitude of the bias forces $F_1$ and $F_2$ will differ. For example, if the latch mechanism 32 moves closer to the first bumper 52, thereby flexing the first arm 50 more than the second arm 54, the magnitude of the bias force $F_1$ will be greater than the magnitude of the bias force $F_2$, thereby operating to center the latch mechanism 32 between the first bumper 52 and the second bumper 56 of the first biasing mechanism 46 and the second biasing mechanism 48 respectively.

The first arm 50 and the second arm 54 each include a spring 70 to generate the bias force. For example, the first arm 50 and the second arm 54 may each include a piece of spring steel attached to the latch mechanism 32 at the first axis 58 and the second axis 60 respectively. Alternatively, the first arm 50 and the second arm 54 may each include a coil spring interconnecting the first arm 50 and the second arm 54 to the latch mechanism 32. It should be appreciated that the first arm 50 and the second arm 54 may be configured and attached to the latch mechanism 32 in any manner capable of allowing the first arm 50 and the second arm 54 to generate the bias forces $F_1$ and $F_2$ when engaged and flexed inward by the first bumper 52 and the second bumper 56 respectively.

The first bumper 52 and the second bumper 56 may each include and be manufactured from an elastomeric material, including but not limited to a rubber material, or may alternatively include some other material capable of damping the movement between the first arm 50 and the first bumper 52, and the second arm 54 and the second bumper 56.

The first biasing mechanism 46 may further include a first damping pad 72 attached to the first arm 50. The first damping pad 72 is configured for engaging, i.e., contacting, the first bumper 52. The second biasing mechanism 48 may further include a second damping pad 74 attached to the second arm 54. The second damping pad 74 is configured for engaging, i.e., contacting, the second bumper 56. The first damping pad 72 and the second damping pad 74 assist to dampen the movement of the first arm 50 relative to the first bumper 52 and the second arm 54 relative to the second bumper 56 respectively. The first damping pad 72 and the second damping pad 74 may include an elastomeric material, including but not limited to a rubber material, or may alternatively include some other material capable of damping the movement between the first arm 50 and the first bumper 52, and the second arm 54 and the second bumper 56.

The first biasing mechanism 46 may further include a first compression block 76. The first compression block 76 is attached to the latch mechanism 32 in a fixed position relative to the first axis 58, and is disposed inward of the first arm 50 relative to the path 38. As shown in FIG. 3, the first arm 50 contacts and compresses the first compression block 76 in response to the first arm 50 flexing inward beyond a pre-determined limit, thereby providing additional damping resistance to the movement of the latch mechanism 32 along the path 38 of the latch mechanism 32. The pre-determined limit is the point at which the first arm 50 flexes inward toward and initially engages the first compression block 76. The further the first arm 50 flexes inward beyond the pre-determined limit of the first arm 50, the more the first compression block 76 is compressed. Similarly, the second biasing mechanism 48 may further include a second compression block 78. The second compression block 78 is independently compressible relative to the first compression block 76. The second compression block 78 is attached to the latch mechanism 32 in a fixed position relative to the second axis 60, and is disposed inward of the second arm 54 relative to the path 38. As shown in FIG. 3, the second arm 54 contacts and compresses the second compression block 78 in response to the second arm 54 flexing inward beyond a pre-determined limit, thereby providing additional damping resistance to the movement of the latch mechanism 32 along the path 38 of the latch mechanism 32. The pre-determined limit is the point at which the second arm 54 flexes inward toward and initially engages the second compression block 78. The further the second arm 54 flexes inward beyond the pre-determined limit of the second arm 54, the more the second compression block 78 is compressed.

The first compression block 76 and the second compression block 78 may include but are not limited to a viscoelastic material, or may alternatively include some other material capable of damping the movement of the first arm 50 and the second arm 54 beyond their respective pre-determined limits. Furthermore, the first compression block 76 and the second compression block 78 may alternatively include a damping mechanism, such as but not limited to a hydraulic damper, a pneumatic damper, a coil spring 70, or some other similar mechanism capable of damping the movement of the first arm 50 and the second arm 54 beyond their respective pre-determined limits.

As shown in FIG. 2, the first arm 50 and the second arm 54 provide a first damping rate to resist movement of the latch mechanism 32 along the path 38 of the latch mechanism 32, i.e., dampen movement within the closure assembly 28. The first damping rate is the bias force provided by the first arm 50 acting against the first bumper 52 and/or the second arm 54 acting against the second bumper 56. If the latch mechanism 32 moves further inward, thereby flexing the first arm 50 and/or the second arm 54 inward into engagement with the first compression block 76 and the second compression block 78 respectively, then the first compression block 76 and/or the second compression block 78 operate to provide a second damping rate, as shown in FIG. 3 to further dampen movement within the closure assembly 28. The second damping rate is the bias force provided by the first arm 50 in combination with the first compression block 76, and/or the second arm 54 in combination with the second compression block 78.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A closure assembly for securing a moveable panel relative to a body of a vehicle, the closure assembly comprising:

a striker assembly having a base and a wire striker fixedly attached to the base;

a latch mechanism moveable along a path between a closed position configured for engaging the wire striker in interlocking engagement to secure the latch mechanism relative to the striker assembly, and an open position configured for not engaging the wire striker in interlocking engagement to allow movement of the latch mechanism along the path relative to the striker assembly; and a biasing mechanism including a bumper fixedly attached to the base of the striker assembly, and an arm fixedly attached to the latch mechanism;

wherein the arm is flexible about an axis in one of an inward direction toward or an outward direction away from the path;

wherein the arm engages the bumper and is moved inward toward the path in response to movement of the latch mechanism from the open position into the closed position; and wherein the inward movement of the arm biases the latch mechanism in both a lateral direction relative to the path and an axial direction along the path, to dampen movement of the latch mechanism relative to the striker assembly.

2. A closure assembly as set forth in claim 1 wherein the biasing mechanism further includes a compression block fixedly attached to the latch mechanism and disposed inward of the arm relative to the path, wherein the arm contacts and compresses the compression block after flexing inward toward the path beyond a pre-determined limit.

3. A closure assembly as set forth in claim 2 wherein the compression block includes a viscoelastic material.

4. A closure assembly as set forth in claim 2 wherein the arm provides a first damping rate for damping movement of the latch mechanism relative to the striker assembly, and wherein the compression block provides a second damping rate for damping movement of the latch mechanism relative to the striker assembly.

5. A closure assembly as set forth in claim 2 wherein the bumper presents a contact surface for engaging the arm, wherein the contact surface is angled relative to the path to define a contact angle.

6. A closure assembly as set forth in claim 5 wherein the contact angle is between the range of 15° and 75°.

7. A closure assembly as set forth in claim 2 wherein the biasing mechanism includes a first biasing mechanism and a second biasing mechanism, wherein the first biasing mechanism and the second biasing mechanism are substantially mirror images of each other, with the first biasing mechanism disposed opposite the second biasing mechanism on opposing lateral sides of the path.

8. A closure assembly as set forth in claim 7 wherein the first biasing mechanism includes a first bumper, a first arm and a first compression block, and wherein the second biasing mechanism includes a second bumper, a second arm and a second compression block.

9. A closure assembly as set forth in claim 8 wherein the first arm is independently flexible relative to the second arm, and wherein the first compression block is independently compressible relative to the second compression block.

10. A closure assembly as set forth in claim 1 wherein the arm includes a damping pad attached thereto and positioned to engage the bumper.

11. A closure assembly as set forth in claim 10 wherein the damping pad includes an elastomeric material.

12. A closure assembly as set forth in claim 1 wherein the arm includes a spring.

13. A vehicle comprising:

a body defining an opening;

a panel moveably attached to the body for selectively sealing the opening; and a closure assembly for securing the panel relative to the body, the closure assembly including:

a striker assembly having a base and a wire striker fixedly attached to the base;

a latch mechanism moveable along a path between a closed position configured for engaging the wire striker in interlocking engagement to secure the latch mechanism relative to the striker assembly, and an open position configured for not engaging the wire striker in interlocking engagement to allow movement of the latch mechanism along the path relative to the striker assembly; and a biasing system including a first biasing mechanism and a second biasing mechanism;

wherein the first biasing mechanism and the second biasing mechanism are substantially mirror images of each other, with the first biasing mechanism disposed opposite the second biasing mechanism on opposing lateral sides of the path;

wherein each of the first biasing mechanism and the second biasing mechanism includes a bumper fixedly attached to the base of the striker assembly, and an arm fixedly attached to the latch mechanism;

wherein the arm of each of the first biasing mechanism and the second biasing mechanism is flexible about an axis in one of an inward direction toward or an outward direction away from the path;

wherein the arm of each of the first biasing mechanism and the second biasing mechanism engages the bumper of the first biasing mechanism and the second biasing mechanism respectively, and is moved inward toward the path in response to movement of the latch mechanism from the open position into the closed position; and wherein the inward movement of the arm of each of the first biasing mechanism and the second biasing mechanism biases the latch mechanism in both a lateral direction relative to the path and an axial direction along the path, to dampen movement of the latch mechanism relative to the striker assembly.

14. A vehicle as set forth in claim 13 wherein each of the first biasing mechanism and the second biasing mechanism further include a compression block fixedly attached to the latch mechanism and disposed inward of the arm of the first biasing mechanism and the second biasing mechanism respectively relative to the path, wherein the arm of each of the first biasing mechanism and the second biasing mechanism contacts and compresses the compression block of the first biasing mechanism and the second biasing mechanism respectively after flexing inward toward the path beyond a pre-determined limit.

15. A vehicle as set forth in claim 14 wherein the bumper of each of the first biasing mechanism and the second biasing mechanism presents a contact surface for engaging the arm, wherein the contact surface is angled relative to the path to define a contact angle.

16. A vehicle as set forth in claim 15 wherein the contact angle is between the range of 15° and 75°.

17. A vehicle as set forth in claim 14 wherein the arm of the first biasing mechanism is independently flexible relative to the arm of the second biasing mechanism, and wherein the compression block of the first biasing mechanism is independently compressible relative to the compression block of the second biasing mechanism.

18. A vehicle as set forth in claim 13 wherein the arm of each of the first biasing mechanism and the second biasing mechanism includes a damping pad attached thereto and positioned to engage the bumper of the first biasing mechanism and the second biasing mechanism respectively.

19. A vehicle as set forth in claim 13 wherein the arm of each of the first biasing mechanism and the second biasing mechanism includes a spring.

* * * * *